US008806887B2

(12) United States Patent
Silva Dias

(10) Patent No.: US 8,806,887 B2
(45) Date of Patent: Aug. 19, 2014

(54) CONSTRUCTIVE ARRANGEMENT INSERTED INTO A CONDENSING UNIT PROVIDED WITH BIDIRECTIONAL FLOW

(75) Inventor: Pedro Mauricio da Silva Dias, Estado de Sao Paulo (BR)

(73) Assignee: Heatcraft Do Brasil Ltda, Sao Paulo (BR)

( * ) Notice: Subject to any disclaimer, the term of this patent is extended or adjusted under 35 U.S.C. 154(b) by 1149 days.

(21) Appl. No.: 12/610,789

(22) Filed: Nov. 2, 2009

(65) Prior Publication Data

US 2010/0132401 A1 Jun. 3, 2010

(30) Foreign Application Priority Data

Nov. 3, 2008 (BR) ..... MU 8802484-9

(51) Int. Cl.

| | |
|---|---|
| ***F25B 39/04*** | (2006.01) |
| ***F25D 23/00*** | (2006.01) |
| ***F28D 3/00*** | (2006.01) |
| ***F24F 1/50*** | (2011.01) |
| ***F04B 17/00*** | (2006.01) |
| ***F24F 1/46*** | (2011.01) |
| ***F24F 1/38*** | (2011.01) |

(52) U.S. Cl.

CPC ..... *F24F 1/38* (2013.01); *F25D 23/006* (2013.01); *F28D 3/00* (2013.01); *F24F 1/50* (2013.01); *F04B 17/00* (2013.01); *F24F 1/46* (2013.01); *F25B 39/04* (2013.01)

USPC ..... 62/507

(58) Field of Classification Search

CPC ..... F24F 1/38; F24F 1/46; F24F 1/50; F25D 23/006; F28D 3/00; F04B 17/00

USPC ..... 62/298, 299, 77, 297, 326, 426, 428, 62/452, 454, 455, 448, 449, 450, 507, 513, 62/171, 183, 259.1; 312/100, 101, 236; 454/233, 236; 165/137; 417/424

See application file for complete search history.

(56) References Cited

U.S. PATENT DOCUMENTS

| | | | | | |
|---|---|---|---|---|---|
| 2,522,623 | A | * | 9/1950 | Kas et al. | 62/297 |
| 3,678,993 | A | * | 7/1972 | Pierce | 165/76 |
| 4,109,708 | A | * | 8/1978 | Imral | 165/48.1 |
| 4,153,310 | A | * | 5/1979 | Loving et al. | 312/100 |
| 4,171,937 | A | * | 10/1979 | Greenfield | 417/423.15 |
| 4,554,796 | A | * | 11/1985 | Stankard | 62/326 |
| 4,911,234 | A | * | 3/1990 | Heberer et al. | 165/125 |
| 5,377,503 | A | * | 1/1995 | Reedy et al. | 62/326 |
| 5,542,263 | A | * | 8/1996 | Choi et al. | 62/262 |
| 5,685,166 | A | * | 11/1997 | Li | 62/428 |
| 5,775,119 | A | * | 7/1998 | Yamada et al. | 62/259.1 |

(Continued)

*Primary Examiner* — Frantz Jules
*Assistant Examiner* — Emmanuel Duke
(74) *Attorney, Agent, or Firm* — Sutherland Asbill & Brennan LLP

(57) ABSTRACT

A new constructive arrangement inserted into a condensing unit provided with bidirectional flow, thus allowing the flow of the machine to be disposed either vertically or horizontally, according to the required application having a base to which an "L" shaped condensing coil is attached, and further receiving a compressor in the center thereof and a side panel on the side thereof, for receiving a structural "L" shaped air scoop, provided with a motor fan on one of the faces thereof that allows the assembly to be closed with said fan being positioned either vertically or horizontally.

20 Claims, 3 Drawing Sheets

(56) References Cited

U.S. PATENT DOCUMENTS

| | | | | |
|---|---|---|---|---|
| 5,967,228 | A * | 10/1999 | Bergman et al. | 165/184 |
| 6,101,829 | A * | 8/2000 | Robinson | 62/259.1 |
| 6,223,545 | B1 * | 5/2001 | Kinkel et al. | 62/171 |
| 7,260,953 | B2 * | 8/2007 | Kim et al. | 62/262 |
| 7,266,956 | B2 * | 9/2007 | Norrell et al. | 62/125 |
| 2005/0235690 | A1 * | 10/2005 | Jung et al. | 62/513 |
| 2005/0257535 | A1 * | 11/2005 | Jung et al. | 62/94 |
| 2007/0156373 | A1 * | 7/2007 | Yamashita et al. | 702/182 |
| 2007/0163295 | A1 * | 7/2007 | Martin et al. | 62/507 |

* cited by examiner

CONSTRUCTIVE ARRANGEMENT INSERTED INTO A CONDENSING UNIT PROVIDED WITH BIDIRECTIONAL FLOW

RELATED APPLICATIONS

This application claims the benefit of the priority date of Brazilian patent application MU 8802484-9 filed on Nov. 3, 2008, the contents of which are herein incorporated by reference.

FIELD OF INVENTION

The present disclosure is related to condensing units, and in particular to arrangements inserted into a condensing unit provided with bidirectional flow, thus allowing the flow thereof to be disposed either vertically or horizontally, according to the required application.

BACKGROUND

The condensing unit is one of the main components of a system for providing weather conditioned commercial-industrial environments that are widely used in industries, supermarkets, shopping malls, cooling chambers, and the like.

In order to be efficient and attain the expected functioning of such systems, a correct dimensioning of the components that change according to the application is required. But three components are indispensable in any unit: the compressor, the condenser and the motor fan.

The function of the motor fan, together with the condenser, is to remove the heat from the fluid and for such it inhales or exhales the heat discarded by the condenser, and the positioning thereof defines the air flow of a system.

One of the requirements for the system to attain the expected capacity and a homogeneous functioning is that the motor fan shall have the required free area where it may operate without any restriction, and a further requirement is that it can be accessed and maintained easily.

Presently, in the condensing units, the motor fan is connected to the condenser by means of an air scoop so that the units may have either a horizontal flow or a vertical flow.

Such items as cost, space and maintenance are preponderant in the selection of equipment, and they should be foreseen at the beginning of the design of the system, since additional costs are generated in the event they are adjusted as the design is being developed or re-dimensioned, besides the fact that adaptation is not allowed; another problem that is common in this type of equipment is the difficulty in installing and maintaining the same due to the disposition of the components.

SUMMARY

In view of the above mentioned problems and aiming at solving the same, in order to fulfill the above described objects, provision is made for a new constructive arrangement inserted into a condensing unit provided with bidirectional flow that makes it possible to install the same according to the needs and the available area of the design, and the decision about the direction of the air flow should be made at any time without affecting the cost or available area foreseen therefore.

In accordance with the present invention, the motor fan is connected to a structural air scoop that also serves for closing the unit, the air scoop being symmetrical and able to be used in either horizontal flow or vertical flow, thus making it easier to maintain in view of the fact that it is positioned outside the unit.

The L-shaped condenser provides a wider use of the area and a better performance in the two dispositions of the motor fan on the side panel, since connection outputs, measuring and maintenance points of the system and the control box are placed next to the condenser and the air scoop for closing the unit.

Besides allowing the mobility of the air flow, the condensing unit is fully closed for decreasing the degradation factors, thus decreasing the maintenance cycling.

Thus, the object of the new constructive arrangement inserted into condensing units provided with bidirectional flow is to provide flexibility in the installation of the equipment, as well as obtain more protected equipment that can be easily installed and maintained.

Another object is to provide simple technical means that makes it possible for the installer to define how he/she is going to install the machine, depending on its application and physical space, without adding value or space to his/her choice.

Still one another object of the present invention is to provide a safe practical way for the installation and maintenance of the whole system of the unit, since the connection and maintenance interfaces thereof are disposed in such a way that it may be easily and plainly accessed.

Schematic figures of a particular embodiment of the invention are given below, the dimensions and ratios of which are not necessarily real, since the sole purpose of the figures is to didactically present one of the preferred embodiments thereof, whose scope of protection is determined by the scope of the attached claims.

The invention will be described hereinbelow based on the attached drawings wherein:

DETAILED DESCRIPTION

Figure 1:
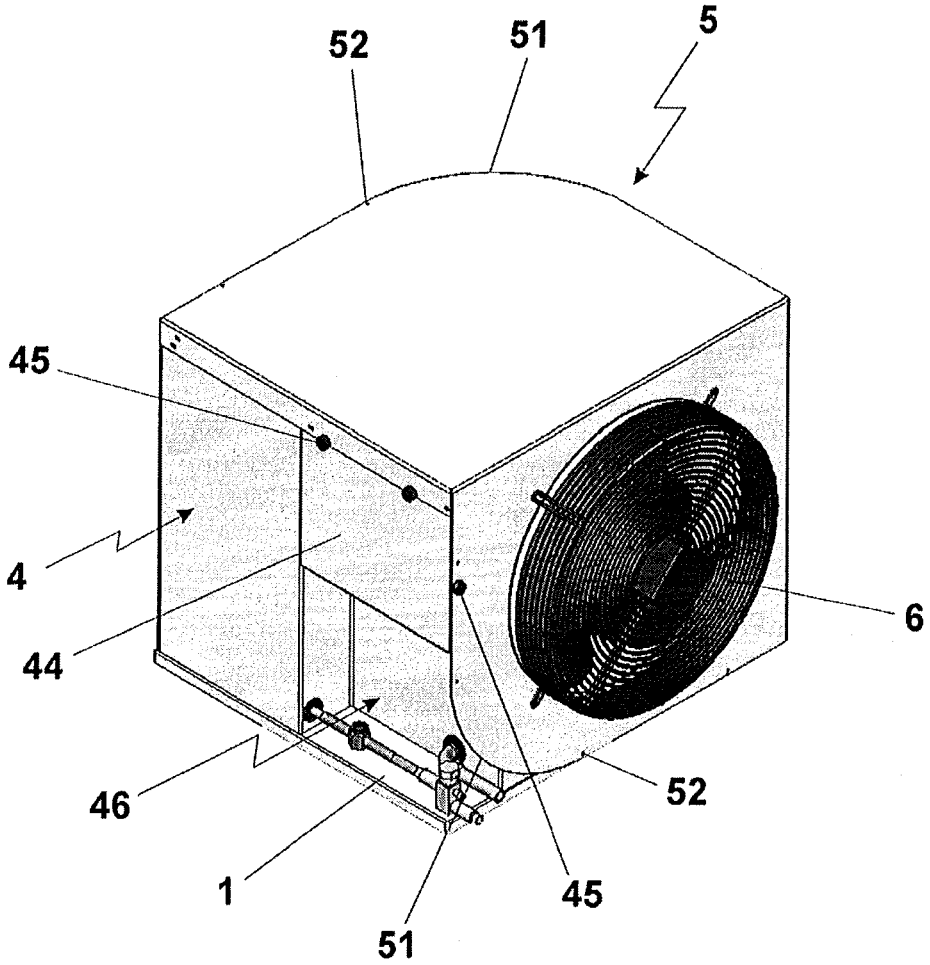
FIG. 1 is a perspective view of the new constructive arrangement inserted into a condensing unit provided with bidirectional flow having a horizontal flow.
Figure 2:
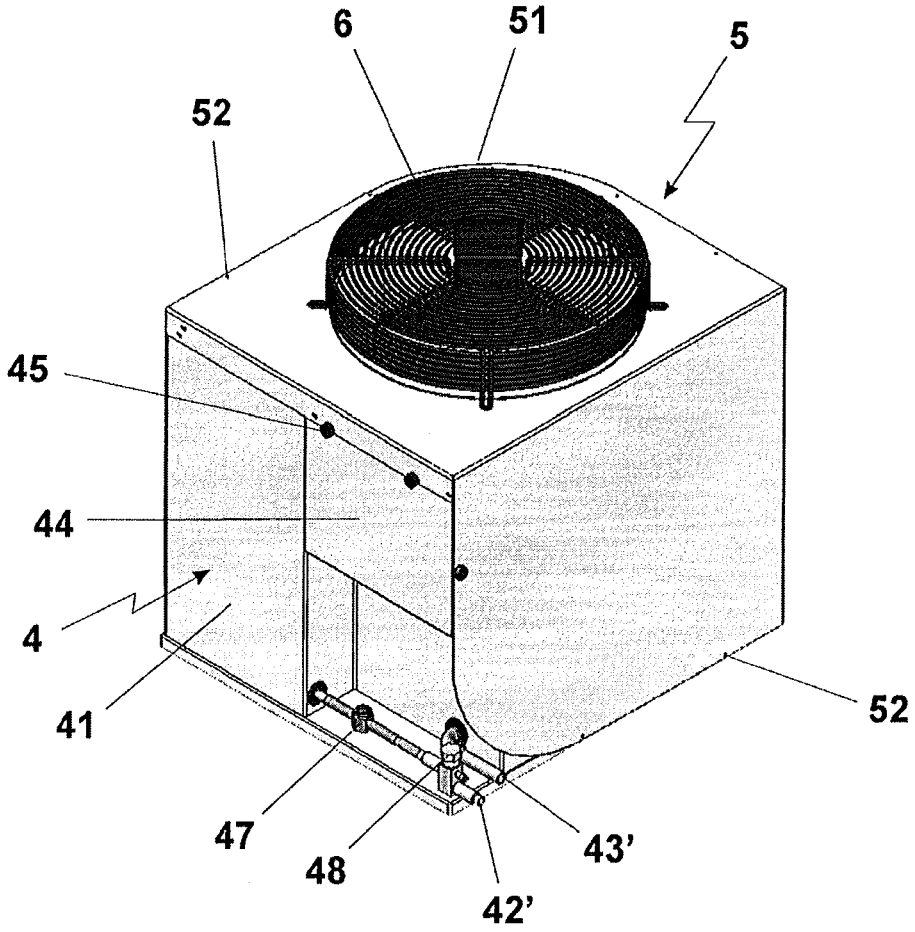
FIG. 2 is a perspective view of the new constructive arrangement inserted into a condensing unit provided with bidirectional flow having a vertical flow.

In accordance with what is illustrated in the above mentioned figures, the object of the arrangement disclosed herein comprises a square or rectangular base (1), having in one of its corners a radius that follows the curvature of the "L" shaped condensing coil (2) that is fixed thereto, following its perimeter and further receiving a compressor (3) in the center thereof and a side panel (4) on the side thereof, the upper front part of the unit being open to receive a structural "L" shaped air scoop (5) provided with a motor fan (6) on one of the faces thereof, allowing the assembly to be closed with the fan positioned either vertically or horizontally.

The side panel (4) is comprised of an "S" shaped body (41) having a number of holes (42 and 43) for the passage of the output connection (42') and input connection (43') respectively, and an "L" shaped body (44) in the upper region of the part located more distant from the edge thereof for placing the electric box that is imbedded in the side panel (4) and fixed by handles (45) that make it easier to open the same, the side panel (4) forming an open part (46) that allows easy access to the output connections (42') and input connections (43') beyond the points of control of the liquid display (47) and the closing valve (48), so that it is not required to open the whole unit.

Figure 3:
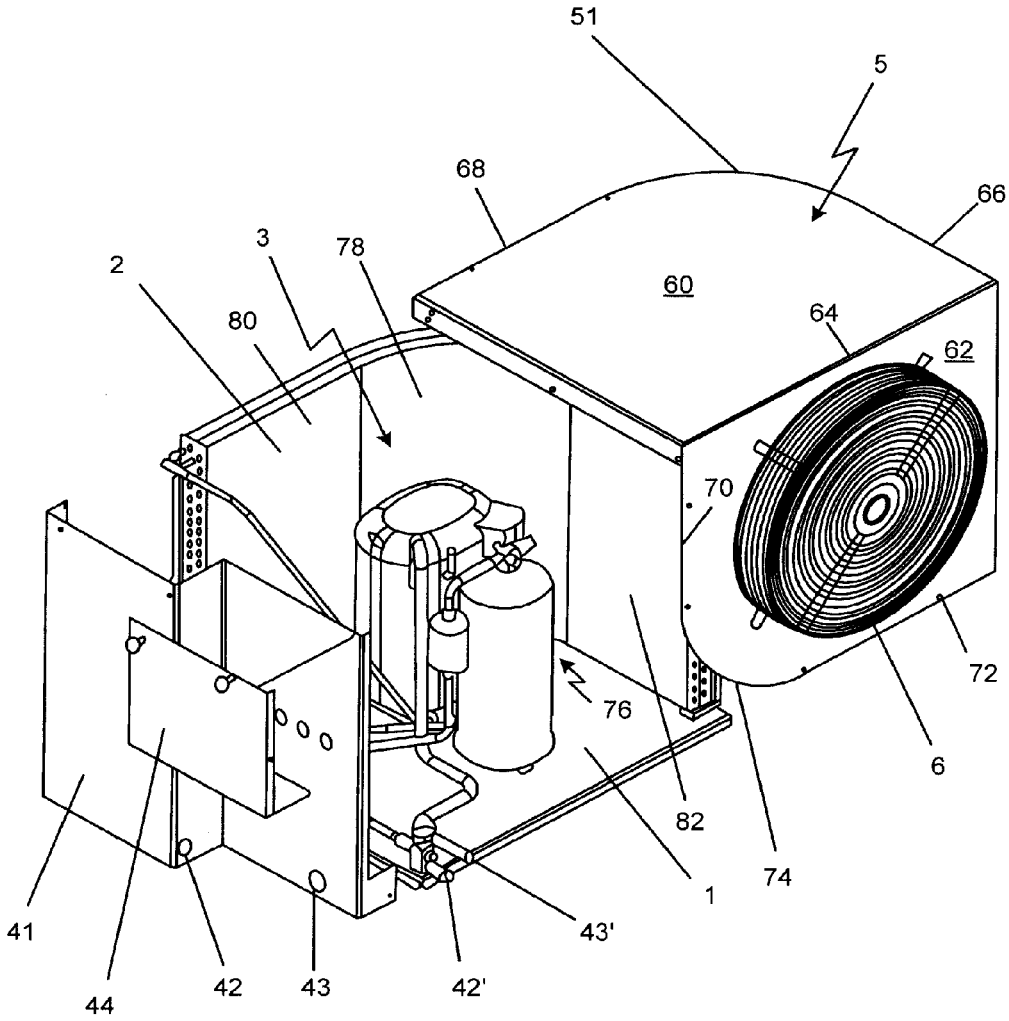
FIG. 3 is a perspective view of the new constructive arrangement inserted into a condensing unit provided with bidirectional flow.

Referring to FIG. 3, one embodiment of the unit is illustrated in exploded view. The unit includes the structural air scoop 5. The structural air scoop 5 includes a first face 60 and a second face 62 meeting at an edge 64. The first face 60 includes a first scoop leg 66 extending away from the edge 64 towards radius 51. The first face 60 includes a second scoop leg 68 substantially perpendicular to the first scoop leg 66 and positioned such that radius 51 is in between the first scoop leg 66 and the second scoop leg 68, such that the radius 51 forms a corner of the first face 60. In some embodiments, radius 51 may follow the radius or curvature of the base 1 and/or the coil 2. The second face 62 of the structural air scoop 5 similarly includes a first scoop leg 70 and a second scoop leg 72 that is substantially perpendicular to the first scoop leg 70. Radius 74 forms a corner of the second face 62 of the structural air scoop 5 and is positioned in between the first scoop leg 70 and the second scoop leg 72 of the second face 62. In some embodiments, radius 74 may have the same curvature as radius 51, such that the structural air scoop 5 may be positioned in different orientations relative to the base 1. To allow for different configurations and/or positioning of the structural air scoop 5, the base 1 may have a radius 76 at one corner that is substantially equal to radii 51 and 74. Also, the coil 2 may have a radius 78 between a first leg 80 and a second leg 82 of the coil 2 that is substantially equal to radii 51, 74, and 76.

The structural air scoop (5) is provided in the two opposing free corners with radius (51) that follow the curvature of the base (1) and the coil (2), thus providing a perfect fixation of the unit through screws (52) or any other attaching means.

Thus, the procedure for changing the flow of the unit consists of removing the screws (52) of the air scoop (5) and changing the same from the horizontal position to the vertical position, or vice versa, and then placing the screws (52) back.

In the basic construction described hereinabove, the object of the present utility model application may present modifications with relation to the shape of the cabinet and the panel, dimensions, constructive or configurative details, such as: the constructive shape of the condensing unit that may be changed, or constructive improvements in the coil (2), the side panel (4) or the air scoop (5), thus keeping the flow change concept.

The system (52) that affixes the coil (2) to the panel (4) next to the air scoop (5) may comprise fit-in locks, or another similar fixation system.

Since the unit is fully closed, an additional advantage thereof is that it prevents damages caused by the weather and objects that may get into the unit, also decreasing the accumulation of dirt and decreasing the cleaning cycling that is required in most of the applications.

The scope of the present utility model application, therefore, should not have to be limited to the illustrated applications, but rather to the terms defined in the claims and its equivalents.

The invention claimed is:

1. A constructive arrangement inserted into a condensing unit provided with bidirectional flow, said arrangement comprising:

a base, where an "L" shaped condensing coil is fixed, and further receiving a compressor in a center of the base, a side panel forming a sidewall of the condensing unit, an air scoop having a structural "L" shape; and a motor fan mounted on the air scoop and configured to move with the air scoop such that the motor fan may be positioned in a vertical or horizontal orientation relative to the base, wherein an upper frontal part of the unit is open to receive the air scoop thereby allowing the condensing unit to be closed when the fan is disposed in either the vertical or horizontal orientation.

2. The constructive arrangement inserted into the condensing unit provided with bidirectional flow according to claim 1, wherein the base has a radius in one corner that follows a curvature of the radius of the "L" shaped condensing coil.

3. The constructive arrangement inserted into the condensing unit provided with bidirectional flow according to claim 1, wherein the side panel is formed by an "S" shaped body provided with holes for the passage of output connections and input connections, respectively, and an "L" shaped body in an upper region of a part located more distant from an edge thereof for placing an electric box that is imbedded in the side panel and fixed by handles that make it easier to open the same, said side panel forming an open part that allows easy access to the output connections and input connections beyond the points of control of a liquid display and a closing valve.

4. The constructive arrangement inserted into the condensing unit provided with bidirectional flow according to claim 1, wherein the air scoop is provided with radii that follow the curvature of the base and the "L" shaped condensing coil.

5. The constructive arrangement inserted into the condensing unit provided with bidirectional flow according to claim 1, wherein the unit is affixed through screws or other attaching means.

6. The constructive arrangement inserted into the condensing unit provided with bidirectional flow according to claim 1, wherein the condensing unit has a shape to place the air scoop either vertically or horizontally.

7. The constructive arrangement inserted into the condensing unit provided with bidirectional flow according to claim 1, wherein the condensing unit makes it possible to change the air flow by changing the position of the air scoop on both the "L" shaped condensing coil and the side panel.

8. The constructive arrangement inserted into the condensing unit provided with bidirectional flow according to claim 1, wherein the air scoop at least two faces, and each of the at least two faces comprises a first scoop leg comprising one edge of the face, a second scoop leg comprising another edge of the face, and a radius between the first scoop leg and the second scoop leg.

9. The constructive arrangement inserted into the condensing unit provided with bidirectional flow according to claim 8, wherein the first scoop leg and the second scoop leg comprise an equal length.

10. The constructive arrangement inserted into the condensing unit provided with bidirectional flow according to claim 1, wherein a first face of the air scoop comprises a first radius between two edges of the first face, a second face of the air scoop comprises a second radius between two edges of the second face, and wherein the first radius equals the second radius.

11. The constructive arrangement inserted into the condensing unit provided with bidirectional flow according to claim 10, wherein the "L" shaped condensing coil comprises a third radius and wherein the third radius equals the first radius and the second radius.

12. The constructive arrangement inserted into the condensing unit provided with bidirectional flow according to claim 11, wherein the base comprises a fourth radius and wherein the fourth radius equals the first radius, the second radius, and the third radius.

13. A condensing unit for providing bidirectional flow, comprising:

a base;

a coil positioned about the base;

an air scoop positioned about the base;

the air scoop comprising a first face with a first curved corner, the first face forming a partial sidewall of the condensing unit, and a second face with a second curved corner, the second face forming a partial cover of the condensing unit; and a fan attached to either the first or second face;

wherein the air scoop is configured to be positioned such that the fan may be oriented either vertically or horizontally about the coil; and the first and second faces of the air scoop are substantially planar.

14. The condensing unit of claim 13, wherein the first face comprises a first face first leg, a first face second leg, and a first radius therebetween formed by the first curved corner.

15. The condensing unit of claim 14, wherein the first face first leg and the first face second leg comprise an equal length.

16. The condensing unit of claim 14, wherein the second face comprises a second face first leg, a second face second leg, and a second radius therebetween formed by the second curved corner.

17. The condensing unit of claim 16, wherein the second face first leg and the second face second leg comprise an equal length.

18. The condensing unit of claim 16, wherein the first radius equals the second radius.

19. The condensing unit of claim 14, wherein the coil comprises a first coil leg, a second coil leg, and a coil radius therebetween.

20. The condensing unit of claim 19, wherein the first coil leg and the second coil leg comprise an equal length and wherein the coil radius equals the first radius.

* * * * *